US012310539B2

(12) United States Patent
Tang

(10) Patent No.: US 12,310,539 B2
(45) Date of Patent: May 27, 2025

(54) VERTICAL BATHING MACHINE

(71) Applicant: Menghe Technology (Hainan Yangpu) Co., Ltd., Danzhou (CN)

(72) Inventor: Haoxiong Tang, Hainan (CN)

( * ) Notice: Subject to any disclaimer, the term of this patent is extended or adjusted under 35 U.S.C. 154(b) by 143 days.

(21) Appl. No.: 18/154,918

(22) Filed: Jan. 16, 2023

(65) Prior Publication Data

US 2023/0148800 A1 May 18, 2023

Related U.S. Application Data

(63) Continuation-in-part of application No. PCT/CN2021/075772, filed on Feb. 7, 2021.

(30) Foreign Application Priority Data

Jul. 15, 2020 (CN) ..... 202010678511.4

(51) Int. Cl.
*A47K 3/022* (2006.01)
*A47K 3/28* (2006.01)

(52) U.S. Cl.
CPC ..... *A47K 3/022* (2013.01); *A47K 3/281* (2013.01)

(58) Field of Classification Search
CPC ..... A47K 3/022
USPC ..... 4/597, 606
See application file for complete search history.

(56) References Cited

U.S. PATENT DOCUMENTS 8,621,679 B1 * 1/2014 Donikian ..... A47K 7/024 4/606

FOREIGN PATENT DOCUMENTS

| | | | |
|---|---|---|---|
| CN | 1771876 | A | 5/2006 |
| CN | 203987805 | U | 12/2014 |
| CN | 204146936 | U | 2/2015 |
| CN | 104783712 | A | 7/2015 |
| CN | 104799741 | A | 7/2015 |
| CN | 104814694 | A | 8/2015 |
| CN | 105078338 | A | 11/2015 |
| CN | 109077642 | A | 12/2018 |

(Continued)

OTHER PUBLICATIONS

International search report of PCT/CN2021/075772.

*Primary Examiner* — Lauren A Crane
(74) *Attorney, Agent, or Firm* — Novoclaims Patent Services LLC; Mei Lin Wong

(57) ABSTRACT

The utility model relates to A vertical bathing machine, which relates to A scrubbing bath device, including A mobile device, the mobile device is installed with a scrubbing bath device, scrubbing bath device comprises a friction belt, connecting line A, connecting line B, power device and winding device or elastic device, one end of the connecting line A is connected with the power device, the other end of the connecting line A is connected with one end of the friction belt, the other end of the friction belt is connected with one end of the connecting line B, The other end of the connection line B is connected with the winding device, the device is first fixed by adjusting the device, through the mobile device can control the scrubbing bath device to move up and down, through the power device in the scrubbing bath device can control the friction belt to move horizontally, through the winding device or elastic device can realize the friction belt to the human body for close fitting, Through this device, the human body can get a comprehensive automatic scrubbing, which brings convenience to people's life.

9 Claims, 9 Drawing Sheets

(56) References Cited

FOREIGN PATENT DOCUMENTS

| | | | |
|---|---|---|---|
| CN | 209273588 | U | 8/2019 |
| CN | 210727711 | U | 6/2020 |
| CN | 111802946 | A | 10/2020 |
| CN | 112369948 | A | 2/2021 |
| DE | 202011105504 | U1 | 11/2011 |

* cited by examiner

VERTICAL BATHING MACHINE

TECHNICAL FIELD

The invention relates to a scrubbing bath device, in particular to a vertical bath machine.

BACKGROUND TECHNOLOGY

The scrubbing machine is a structure that works for humans and solves the problem that certain groups of people find it difficult to independently clean the human back during bathing. The general bath washing machine is mostly based on the rotary type of bath washing machine, and assisted by electrical power or reversing equipment. Because this kind of bath washing machine can not simulate artificial up and down motion, resulting in a decline in user comfort, and electrical equipment directly contact with the human body in the process of user bathing, there are great safety risks, high production cost, a large floor area, in order to solve the above technical problems, a new technical solution is proposed.

CONTENTS OF THE INVENTION

In order to solve the problems existing in the prior art, the invention provides A vertical bathing machine, which comprises A mobile device, on which A scrubbing bath device is installed, and the scrubbing bath device comprises a friction belt, connecting line A, connecting line B, a power device and a winding device or an elastic device. One end of the connecting line A is connected with the power device, and the other end of the connecting line A is connected with one end of the friction belt. The other end of the friction belt is connected with one end of the connecting line B, and the other end of the connecting line B is connected with the winding device or the elastic device, and the elastic device can be replaced by the connecting line B.

The mobile device is provided with an auxiliary device, the auxiliary device comprises a box body or a connecting rod and an auxiliary rod, the connecting rod is provided with an auxiliary rod, the auxiliary rod is covered with an auxiliary connection bar.

Between the mobile device and the auxiliary device is provided with a adjusting device, the adjusting device comprises a connecting column, a moving block, a screw cavity, a rotating screw, a fixed plate, an inner column, a sliding block and a sliding cavity, the connecting column is connected with the auxiliary device, the connecting column is connected with one end of the inner column, the other end of the inner column is inserted into the sliding cavity and the sliding block is connected to the sliding cavity, the inner column is provided with a screw cavity, The screw cavity is connected with the rotating screw through the thread, the rotating screw is connected with the output shaft of the motor C and the motor C is located in the fixed plate, the fixed plate is connected with the mobile device, the fixed plate is provided with a power device, the adjustment device is also provided with an auxiliary device.

The friction belt is integrated with a roller and a massage block, the roller and the massage block spacing arrangement.

The mobile device comprises A rotating motor, synchronous wheel A, fixed sleeve, synchronous belt and synchronous wheel B, the fixed sleeve is fixed on the synchronous belt, the fixed sleeve is connected with the connecting block, synchronous belt at both ends are provided with synchronous wheel A and synchronous wheel B, synchronous wheel A or synchronous wheel B is connected with the motor output shaft.

The winding device is a general winding device on the market, which is usually driven by a motor, spring or coil spring.

The power device is A reciprocating mechanism, the power device includes a shell, the shell is fixed with a first motor and loading plate, the output end of the first motor interspersed through the loading plate and the output end of the first motor is fixed on the rotary plate, the loading plate is fixed on the sliding rail, sliding rail is installed on the sliding table, sliding table and rotary table with connecting rod, sliding table and connecting line A end is fixed connected, The turntable can be replaced by a curved rod.

The connecting rod and the rotary plate is arranged at the connection is provided with a adjusting mechanism, the adjusting mechanism comprises a mounting bracket fixed at the bottom of the loading plate, the rotary plate near the installation bracket is provided with a groove, through the groove rotation disk outer edge extends to the center of the circle, through the groove sliding is provided with a connecting block, connecting block and connecting rod one end is hinged, the installation bracket is fixed on the second motor, The output end of the second motor is fixed on the threaded connecting rod, threaded connecting rod and through the groove to the same direction, and threaded connecting rod and connecting block.

The moving device is provided with an outlet water nozzle 11 and/or a soap release device for bathing.

Reciprocating brush plate 10 is fixed on one side of the slide block.

Compared with the prior art, the beneficial effects of the invention are:

1. By adjusting the adjusting device, the adjusting device is adjusted to a certain position, and then the human body steps into the encircling friction belt in the scrubbing bath device. The friction belt will be closely fitted to the human body when connected with the coiling device. At the same time, this device is also driven by the mobile device, which can realize the upward movement of the whole regulating device, so as to realize the full automatic scrubbing bath.
2. Open the first motor to drive the turntable to rotate, which makes the turntable, connecting rod and sliding table form eccentric structural action, the turntable generates torque to push and pull the connecting rod, which drives the sliding table relative sliding rail reciprocating action, and the connecting line A connected to the sliding table reciprocating action, which makes the friction belt wipe action, by controlling the positive and reverse of the second motor, To drive the threaded connection rod to produce the corresponding rotation, so that the connecting block relative through the groove sliding, far away from or close to the center of the turntable, so that the eccentric structure of the connecting end position change, friction belt reciprocating wiping action limit position to be adjusted, providing the human body different amplitude of friction feeling.
3. the friction belt is integrated with a roller and massage block, roller and massage block spacing arrangement, roller and massage block setting can also play a certain massage effect, improve the comfort in the process of bathing.

ATTACHED PICTURE DESCRIPTION

DETAILED DESCRIPTION OF THE EMBODIMENT

Figure 1:
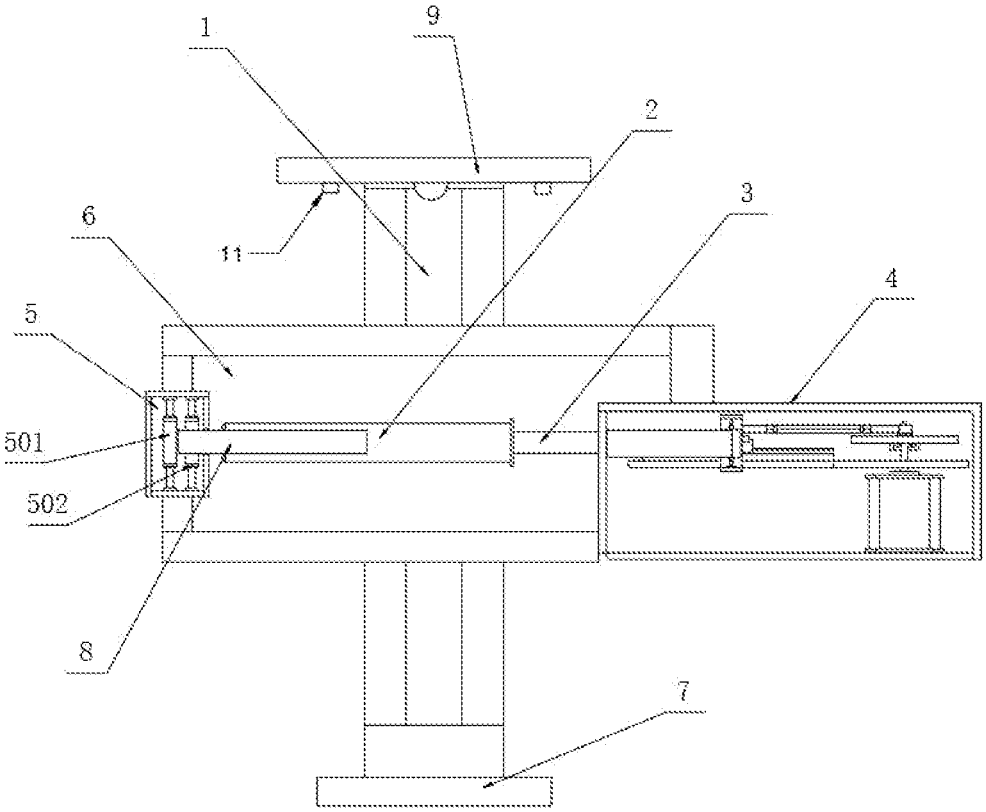
FIG. 1 is a schematic diagram of the overall structure of the invention.
Figure 2:
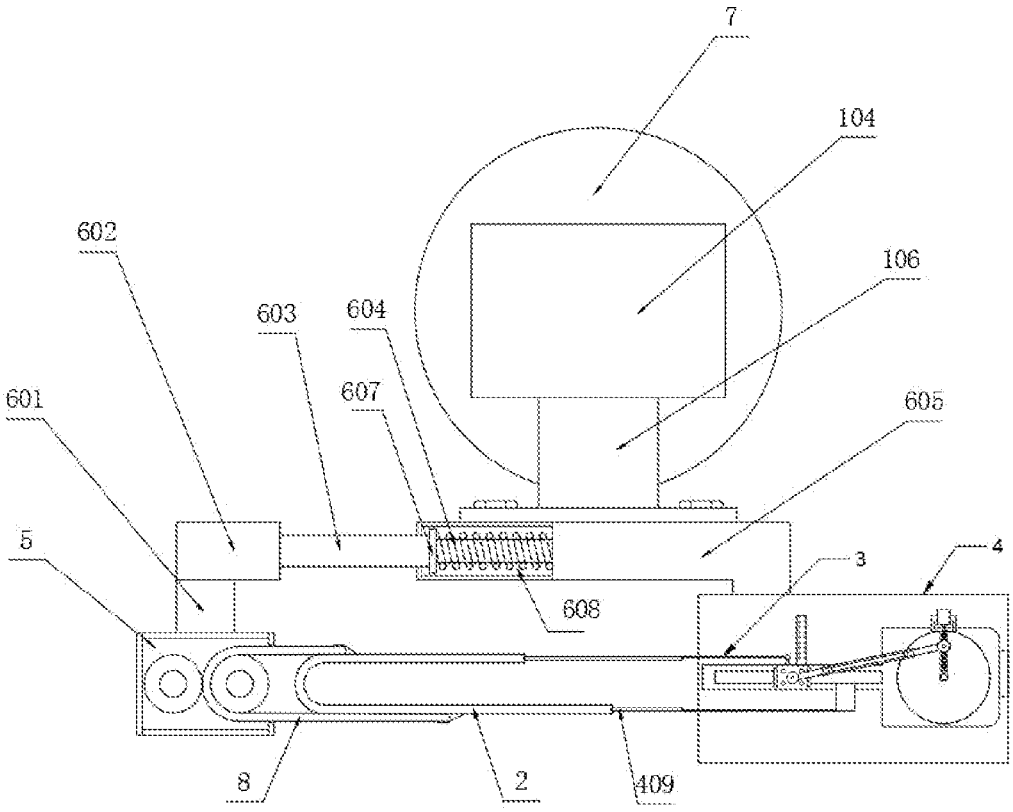
FIG. 2 is a view diagram of the overall structure of the invention.
Figure 3:
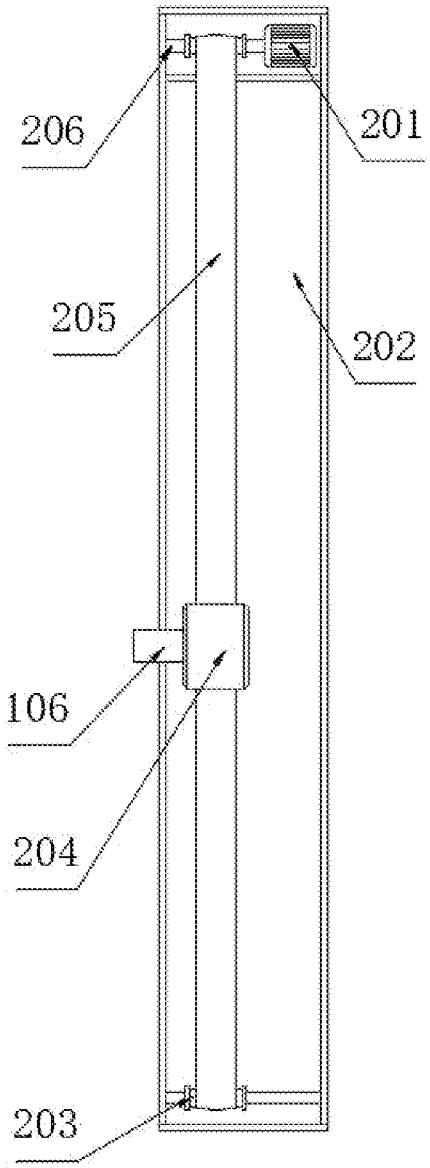
FIG. 3 is the structure diagram of the mobile device of the invention.

In order to make it easy to understand the technical means, creation features, achieving purpose and efficacy of the invention, the invention is further elaborated in combination with the specific embodiments and the attached drawings. However, the following embodiments are only preferred embodiments of the invention, not all of them. Based on the embodiments in the embodiments, other embodiments obtained by technical personnel in the field without creative labor are within the scope of protection of the invention.

Specific embodiments of the invention are described below in conjunction with the attached drawings.

As shown in FIG. 1-9, a vertical bathing machine comprises a mobile device 1, and a scrubbing device is installed on the mobile device 1. The scrubbing device comprises a friction belt 2, a connecting line A3, a connecting line B402, a power device 4 and a winding device 407 or an elastic device. One end of the connecting line A3 is connected with the power device 4, and the other end of the connecting line A3 is connected with one end of the friction belt 2. The other end of the friction belt 2 is connected with one end of the connecting line B402, and the other end of the connecting line B402 is connected with the winding device 407 or the elastic device, the elastic device can be replaced by the connecting line B.

Elastic devices include elastic bands, elastic cords and springs.

The mobile device 1 is connected with the auxiliary device 5, the auxiliary device 5 comprises a box body or a connecting rod and an auxiliary rod, the connecting rod is provided with an auxiliary rod, the auxiliary rod is covered with an auxiliary connecting bar 8.

Between the mobile device 1 and the auxiliary device 5 is provided with an adjusting device 6, the adjusting device 6 comprises connecting column 601, moving block 602, screw cavity 603, rotating screw 604, fixed plate 605, inner column 606, slider 604 and sliding cavity 608, the connecting column 601 and the auxiliary device 5 connection, Connecting column 601 and the inner column 606 one end is connected, the other end of the inner column 606 is inserted into the inner cavity 608 and the slider 607 connection, the slider 607 and the slider 608 is a sliding connection, the inner column 606 is provided with a screw cavity 608, the screw cavity 608 and the rotating screw 604 through the thread connection, The rotating screw 604 is connected with the motor C output shaft and the motor C is located in the fixed plate 605, the fixed plate 605 is connected with the mobile device 1, the fixed plate 605 is provided with a power device 4, the adjusting device 6 is also provided with an auxiliary device 5, this device according to the user's needs, the adjusting device can be replaced by manual adjustment.

The auxiliary device 5 comprises a box body or connecting rod and an auxiliary rod, the box body is connected with the adjusting device, the box body is provided with an auxiliary rod and between the two is a rotary connection, the auxiliary rod is covered with a connection bar 8. The box can be a box, can also be a supporting rod, the main function is to support the auxiliary rod, can realize the normal movement of the auxiliary rod.

The auxiliary rod is provided with bearings including auxiliary rod A501 and auxiliary rod B502, auxiliary rod A501 and auxiliary rod B502 are fixed in the box body, there is a gap between the auxiliary rod A501 and auxiliary rod B502, between the gap is provided with friction belt 2. It plays an auxiliary role in rubbing the human body and moving up and down at the same time with the friction belt.

The mobile device 1 comprises a protective shell 202, a rotating motor 201, synchronous wheel A203, a fixed sleeve 204, a synchronous belt 205 and a synchronous wheel B206. The fixed sleeve 204 is fixed on the synchronous belt 205, and the fixed sleeve 204 is connected with the connecting block 106. Synchronous belt 205 upper and lower ends are respectively provided with synchronous wheel A203 and synchronous wheel B206, synchronous wheel A203 or synchronous wheel B206 and rotating motor 201 output shaft connection, the mobile device 1 can be replaced by other up and down moving mechanism, such as: gear and rack, screw, rope or chain.

According to the needs of use, the mobile device 1 can also be replaced by the following structure, the mobile device 1 including motor A101, screw 102, screw block 103, shell 104, bottom column 105 and connecting block 106, the connecting block 106 end and adjustment device 6 connection, connecting block 106 the other end through the shell 104 and screw block 103 connection, Screw block 103 is provided with a screw 102 and threaded connection between the two, one end of the screw 102 and the motor A101 output shaft is connected, the other end of the screw 102 and the bottom column 105 through the bearing connection.

The mobile device also includes a shell 104, shell 104 package and motor A101, screw 102, screw block 103 and the bottom column 105 outside, the bottom of the mobile device is connected with the base 7, the top of the mobile device 1 is connected with the nozzle 9. The nozzle 9 is connected with the water inlet pipe to provide water. In order to make the water pressure more stable, a booster valve can be added to the nozzle 9 in the process of use to ensure sufficient pressure.

Figure 4:
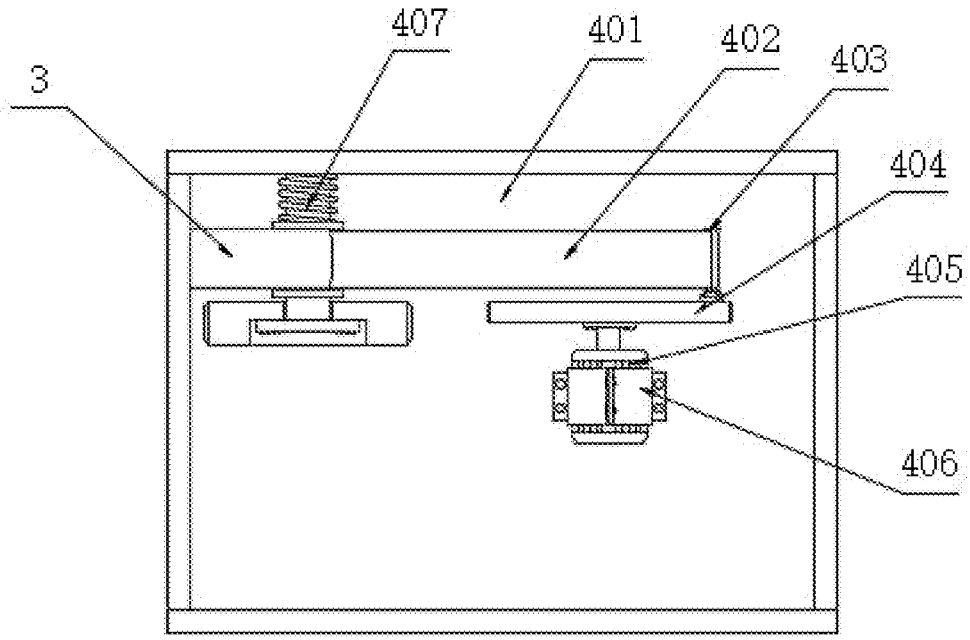
FIG. 4 is the first implementation structure diagram of the power device of the invention.

As shown in FIG. 4, the first implementation of power plant 4 is that the power plant 4 comprises a shell 401, a column 403, a rotating disk 404, a motor 405, a fixed frame 406 and a winder 407. The connecting line A3 is connected with the winder 407, and the winder 407 is fixed inside the shell 401. The connecting line B402 is connected with the column 403, the column 403 is fixed on the rotating disc 404, the central position of the rotating disc 404 is connected with the motor 405 output shaft, and the motor 405 is fixed inside the shell 401 through the fixing frame 406. Power plant 4 between the motor 405 and rotating disc 404, it can be replaced by a synchronous motor positive and negative direct connection line B402, as well as the synchronous belt direct connection line B402, at the same time some other mobile mechanisms can also achieve similar functions, power device can be reciprocating motion device, reciprocating motion device can achieve the content, All can be replaced.

The winding device 407 is a general winding device on the market, which is usually driven by a motor, spring or coil spring.

The specific working principle is as follows: Adjust the equipment before use. First fix the base 7 on the ground, or fix the mobile device 1 on the wall, and then connect the whole device to the power supply. Adjust the adjusting device 6 to a certain position by adjusting the adjusting device 6, and then the human body steps into the encircling friction belt 2 in the scrubbing device. The friction belt 2 and the receiving coil 407 or elastic device will be closely attached to the human body. Then, the power device 4 in the scrubbing device rotates, and the power device 4 drives the friction belt 2 to reciprocate motion, so as to realize the effect of removing the silt on the human body. At the same time, the device is also driven by the mobile device 1, which can realize the whole scrubbing device 6 to move up and down. So as to realize the full automatic full range of scrubbing.

At the same time, in order to achieve the above effect, the power device 4 and the mobile device 1 play a certain role, the following is the power device 4 and the mobile device 1 principle introduction.

The working principle of the mobile device 1 is, first of all, before use can be according to the needs of users, the mobile device 1 can be placed on the ground through the base 7, can also be mobile device 1 shell 104 fixed to the wall, and then by controlling the rotation of the motor A101 to drive the rotation of the screw 102, screw 102 drive the screw block 103 move up and down, Because the screw 102 and the screw block 103 is connected by thread, the screw block 103 and connecting block 106 is connected, connecting block 106 and through the shell 104, can be guided by the shell 104 on the slot, so that the whole adjustment device to move up and down, the speed of moving up and down can be determined by the motor A101 rotation speed.

The working principle of power plant 4 is, first through the winder 407 to tighten the connection belt A3, through the winder 407 can adjust the amplitude of the winder, so that the friction belt is always close around the body, and then rotate through the motor 405, drive the rotating disc 404, when the rotating disc 404 rotation, Placed on the rotating disc 404 column 403 for rotation, column 403 mobile drive connecting line B402, connecting line B402 drive friction belt 2 to move, so as to achieve the reciprocating motion of friction belt 2, so as to achieve the horizontal scrubbing effect. The column 403 in this device can be in the eccentric position of the rotating disc 404, but also in the center of the rotating disc 404.

To sum up, through the combination of horizontal and vertical, to achieve a full range of human body scrubbing effect.

Figure 5:
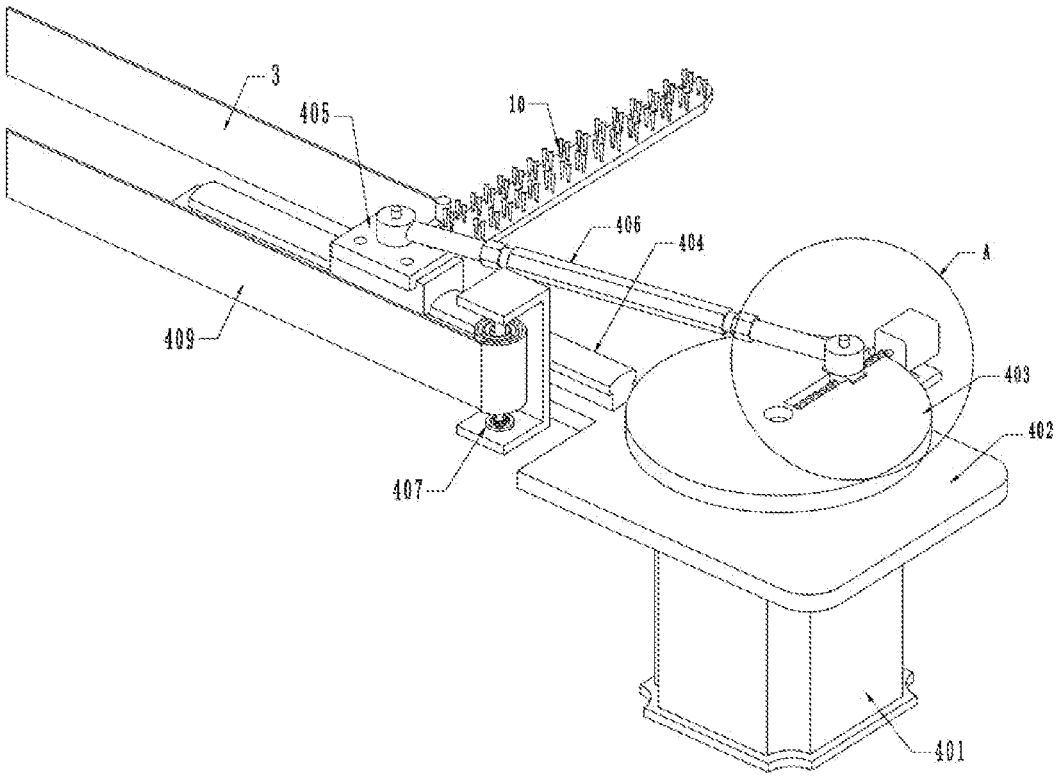
FIG. 5 is the second implementation structure diagram of the power device of the invention.
Figure 6:
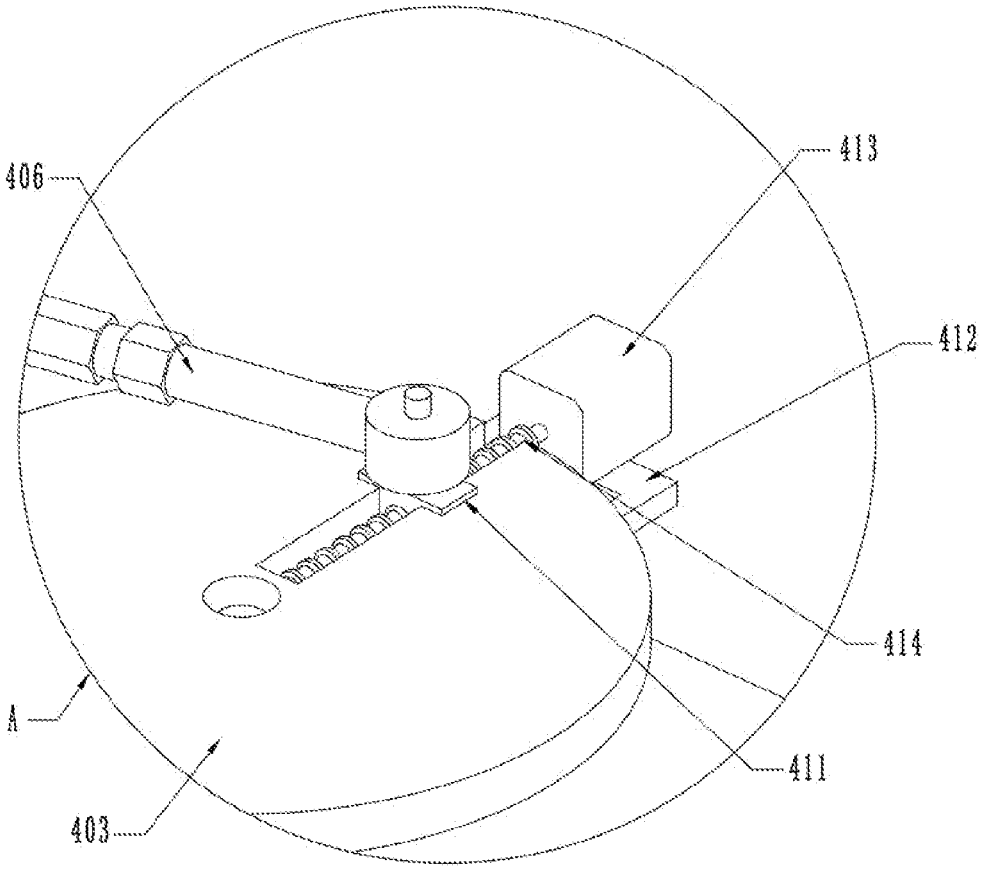
FIG. 6 is the enlarging diagram of A structure in FIG. 5.
Figure 7:
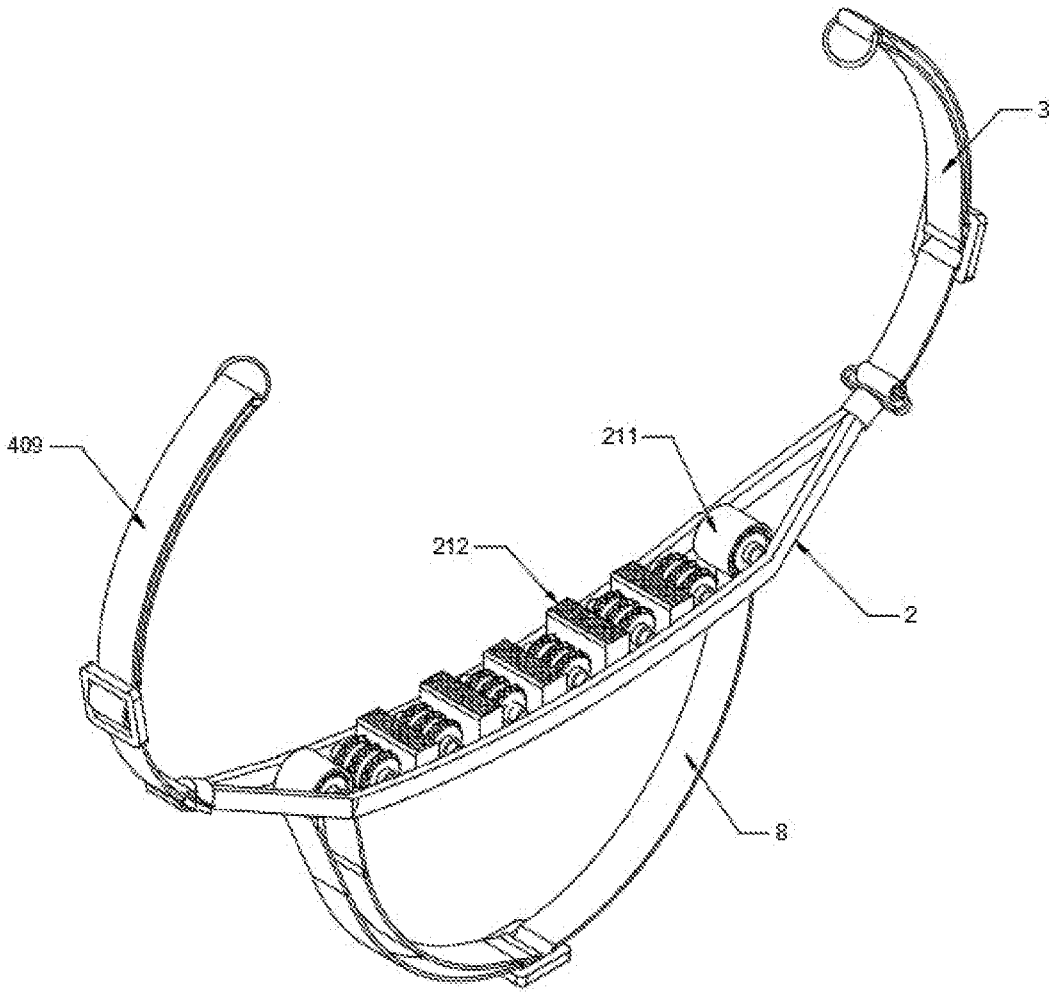
FIG. 7 is the schematic diagram of embodiments 3 of the invention.

As shown in FIG. 5-6, the second implementation of power device 4 can also include reciprocating drive and adjustment of the reciprocating degree, among which the reciprocating drive function lies in:

(1) Open the first motor 401 drive turntable 403 rotation, so that the turntable 403, connecting rod 406 and sliding table 405 formed eccentric structure action, turntable 403 produce torque pushing and pulling connecting rod 406, thereby driving the sliding table 405 relative sliding rail 404 reciprocating action, and the sliding table 405 connected line A3 reciprocating action immediately, So that with the other side and winder 407 or elastic device connection friction belt 2 produced wiping action.

On the basis of the above, the stroke of the eccentric structure can also be adjusted adaptively. The specific role is:

By controlling the positive and reverse of the second motor 413, to drive the threaded connection rod 414 to produce the corresponding rotation, so that the connecting block 411 relative through the groove sliding, far away from or close to the center of the turntable 403, so that the eccentric structure of the connecting end position change, friction belt 2 reciprocating wiping action limit position is adjusted, Provide a feeling of different friction amplitude on the human body.

To sum up, through the combination of horizontal and vertical, to achieve a full range of human body scrubbing effect.

Reciprocating brush plate 10 is fixed on one side of the slide block. Users can brush hands, feet, back and other parts aligned with the reciprocating brush plate 10, and reciprocating brush plate 10 follows the reciprocating action of the slide block.

This device first fixed the scrubbing bath device by adjusting the device, by moving the device 1 can control the scrubbing bath device to move up and down, through the power device 4 in the scrubbing bath device can control the friction belt 2 to move laterally, friction belt 2 is no elastic friction belt, by connecting with the winding device can realize the close fitting of the human body. Through this device, the human body can get a comprehensive automatic scrubbing, which brings convenience to people's life.

When using the product of the invention, the specific cleaning steps are as follows:

The first step starts cleaning. People stand in the friction belt, the soap dispenser on the mobile device sprits foaming liquid into the human body, scrubs one side of the human body at the same time, and then turns around to clean the other side, and then stands out and puts one leg into the C-type friction belt to clean the leg, and then cleans the hands, feet and back through the reciprocating brush plate. The parts that can not be cleaned can be taken out of the friction belt and rubbed artificially.

The second step is to clean the body by spraying water up and down the outlet of the mobile device.

Friction belt 2 is integrated with roller 211 and massage block 212, roller 211 and massage block 212 spacing arrangement, the setting of roller 211 and massage block 212 can also play a certain massage effect, improve the comfort in the process of bathing.

This device has a variety of different uses and a variety of different ways of use, one way is to plug in the power directly for use, with the power supply, the other is to supply direct current through the battery, this way not only makes the use of the device more flexible, and make the device more safe.

Implementation Example 1

Figure 8:
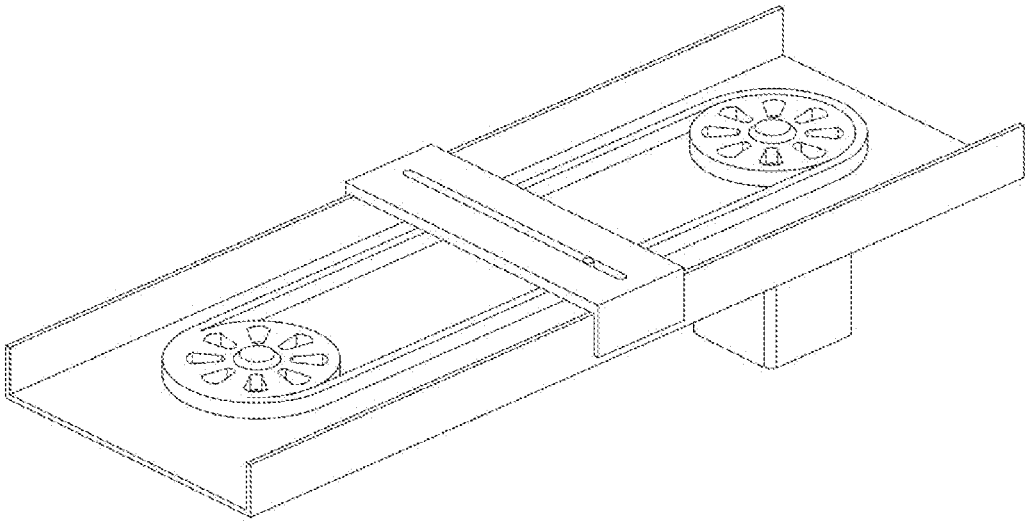
FIG. 8 is the schematic diagram of embodiment I of the invention.
Figure 9:
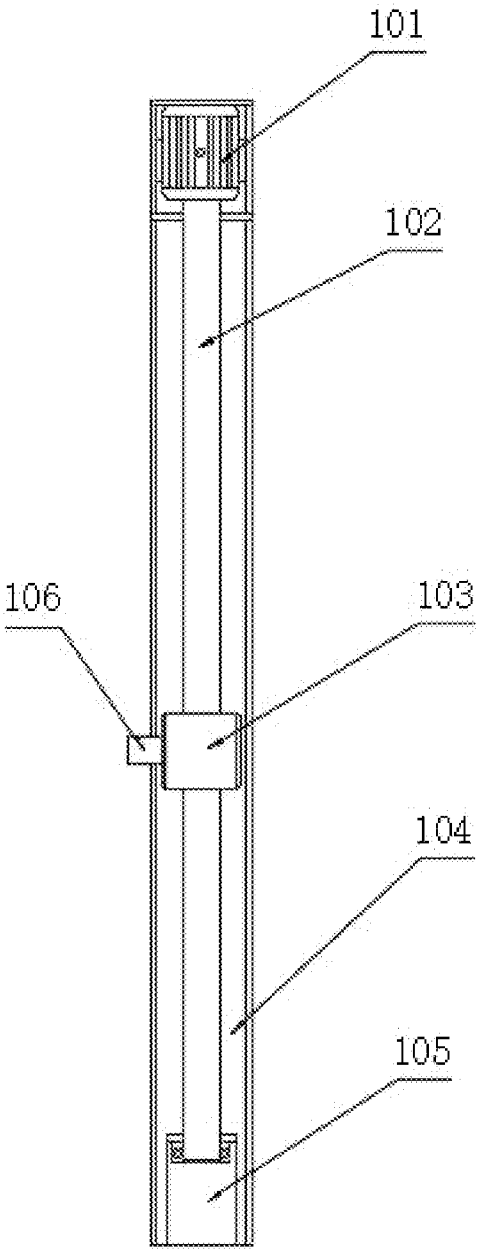
FIG. 9 is a deformation diagram of the mobile device of the invention.

As shown in FIG. 8, the power plant in this device can also be adjusted to a synchronous belt reciprocating motion device.

Embodiment 2

A scrubbing strip with a rolling wheel can be used for massage while bathing, or a strip device with only a rolling wheel can be used for massage alone.

Embodiments 3

The friction belt, connecting line A, connecting line B and the auxiliary connecting belt are integrated devices.

In the description of the invention, it is to be understood that the terms "coaxial", "bottom", "one end", "top", "middle", "other end", "up", "side", "top", "inside", "front", "central", "two ends", etc. indicate bearing or position relationships based on those described in the attached drawings, Only for the convenience of describing and simplifying the description of the invention, but not to indicate or imply that the device or element referred to must have a particular orientation, be constructed and operated in a particular orientation, and therefore cannot be understood as a limitation of the invention.

In the present invention, the terms "installation", "setup", "connection", "fixation", "spiral joint", etc. shall be understood broadly, unless otherwise expressly specified and qualified, for example, they may be fixed, detachable or integrated; They may be mechanical or electrical connections; It may be directly connected or indirectly connected through an intermediate medium, it may be the connection within two components or the interaction between two components, and the specific meaning of the above terms in the present invention may be understood by ordinary technicians in the field according to the circumstances, unless otherwise expressly specified.

Notwithstanding that embodiments of the invention have been shown and described, it is is understandable to the ordinary skilled person in the field that many variations, modifications, substitutions and variations may be made to these embodiments without being separated from the principle and spirit of the invention, and that the scope of the invention is limited by the attached claims and their equivalents.

The invention claimed is:

1. A vertical bath machine, including a mobile device, wherein the mobile device is installed with a scrubbing device and is provided with an auxiliary device, the scrubbing device includes a friction belt arranged for encircling a human body, a connecting line A, a connecting line B, a power device and a winding device or an elastic device, the connecting line A has one end connected with the power device, the other end of the connecting line A is connected with one end of the friction belt, the other end of the friction belt is connected with one end of the connecting line B, the other end of the connecting line B is connected with the winding device or the elastic device, the elastic device can be substituted for connecting line B;

the auxiliary device comprises a box body or a connecting rod, and an auxiliary rod having a rotary connection with the box body or supported by the connecting rod, and the auxiliary rod is covered with an auxiliary connecting strap.

2. The vertical bath machine according to claim 1, wherein an adjusting device is arranged between the mobile device and the auxiliary device, the adjusting device includes a connecting column, a moving block, a screw cavity, a rotating screw, a fixed plate, an inner column, a sliding block and a sliding cavity, the connecting column is connected with the auxiliary device, the connecting column is connected with one end of the inner column, the other end of the inner column is inserted into the inner cavity and the sliding block is connected, the sliding block and the sliding cavity is connected, the inner column is provided with a screw cavity, the screw cavity is connected with the rotating screw through the thread, the rotating screw is connected with the output shaft of the motor C and the motor C is located in the fixed plate, the fixed plate is connected with the mobile device, the fixed plate is provided with a power device, the adjustment device is also provided with an auxiliary device.

3. The vertical bath machine according to claim 2, wherein the friction belt is integrated with a roller and a massage block, and the roller and the massage block are arranged at intervals.

4. A vertical bath machine, including a mobile device, wherein the mobile device is installed with a scrubbing device, the scrubbing device includes a friction belt, a connecting line A, a connecting line B, a power device and a winding device or an elastic device, the connecting line A has one end connected with the power device, the other end of the connecting line A is connected with one end of the friction belt, the other end of the friction belt is connected with one end of the connecting line B, the other end of the connecting line B is connected with the winding device or the elastic device, the elastic device can be substituted for connecting line B;

wherein the mobile device comprises a rotating motor, a synchronous wheel A, a fixed sleeve, a synchronous belt and a synchronous wheel B, the fixed sleeve is fixed on the synchronous belt, the fixed sleeve is connected with the connecting block, synchronous belt at both ends are provided with synchronous wheel A and synchronous wheel B, synchronous wheel A or synchronous wheel B is connected with the motor output shaft.

5. The vertical bath machine according to claim 4, wherein the winding device is a general winding device on the market, which is usually driven by a motor, spring or coil spring.

6. A vertical bath machine, including a mobile device, wherein the mobile device is installed with a scrubbing device, the scrubbing device includes a friction belt, a connecting line A, a connecting line B, a power device and a winding device or an elastic device, the connecting line A has one end connected with the power device, the other end of the connecting line A is connected with one end of the friction belt, the other end of the friction belt is connected with one end of the connecting line B, the other end of the connecting line B is connected with the winding device or the elastic device, the elastic device can be substituted for connecting line B;

wherein power device is a reciprocating mechanism, the power device includes a shell, the shell is fixed with a first motor and loading plate, the output end of the first motor interspersed through the loading plate and the output end of the first motor is fixed on the rotary plate, the loading plate is fixed on the sliding rail, sliding rail is installed on the sliding table, sliding table and rotary table with connecting rod, sliding table and connecting line A end is fixed connected, the turntable can be replaced by a curved rod.

7. The vertical bath machine according to claim 6, wherein the connecting rod and the rotary plate is provided with a adjusting mechanism, the adjusting mechanism includes a mounting bracket fixed at the bottom of the loading plate, the rotary plate near the installation bracket is provided with a groove, through the groove rotation disk outer edge extends to the center of the circle, through the groove sliding is provided with a connecting block, connecting block and connecting rod one end is hinged, the second motor is fixed on the mounting bracket, The output end of the second motor is fixed on the threaded connecting rod, threaded connecting rod and through the groove to the same direction, and threaded connecting rod and connecting block.

8. The vertical bath machine according to claim 4, wherein the mobile device is provided with an outlet water nozzle 11 and/or a soap release device for bathing.

9. The vertical bath machine according to claim 6, wherein the reciprocating brush plate is fixed on one side of the sliding table.

* * * * *